US008174470B2

(12) United States Patent
Ahn et al.

(10) Patent No.: US 8,174,470 B2
(45) Date of Patent: May 8, 2012

(54) LIQUID CRYSTAL DISPLAY DEVICE

(75) Inventors: Byeong Hyeon Ahn, Gumi-si (KR); Seung Kuk Ahn, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 929 days.

(21) Appl. No.: 11/289,385

(22) Filed: Nov. 30, 2005

(65) Prior Publication Data

US 2007/0001976 A1 Jan. 4, 2007

(30) Foreign Application Priority Data

Jun. 30, 2005 (KR) ..... 10-2005-0057575

(51) Int. Cl.
*G09G 3/36* (2006.01)

(52) U.S. Cl. ..... 345/87; 345/98

(58) Field of Classification Search ..... 345/87–104, 345/204

See application file for complete search history.

(56) References Cited

U.S. PATENT DOCUMENTS

| | | | | |
|---|---|---|---|---|
| 4,176,398 | A * | 11/1979 | Rider | 708/8 |
| 5,754,151 | A * | 5/1998 | Moon | 345/92 |
| 6,008,801 | A * | 12/1999 | Jeong | 345/204 |
| 6,166,714 | A * | 12/2000 | Kishimoto | 345/96 |
| 7,119,772 | B2 * | 10/2006 | Amundson et al. | 345/87 |
| 7,342,561 | B2 * | 3/2008 | Hiraki et al. | 345/87 |
| 7,382,343 | B2 * | 6/2008 | Hiraki et al. | 345/96 |
| 2003/0030604 | A1 * | 2/2003 | Moon et al. | 345/87 |
| 2003/0034943 | A1 * | 2/2003 | Takeda | 345/87 |
| 2004/0239602 | A1 * | 12/2004 | Kim et al. | 345/87 |
| 2004/0257329 | A1 * | 12/2004 | Park et al. | 345/102 |
| 2004/0263446 | A1 * | 12/2004 | Kawase et al. | 345/87 |
| 2005/0052395 | A1 * | 3/2005 | Choi et al. | 345/98 |
| 2005/0140639 | A1 * | 6/2005 | Oh et al. | 345/102 |
| 2005/0219179 | A1 * | 10/2005 | Kim | 345/89 |
| 2007/0120791 | A1 * | 5/2007 | Takahashi | 345/89 |
| 2008/0303770 | A1 * | 12/2008 | Oke et al. | 345/92 |

FOREIGN PATENT DOCUMENTS

| | | |
|---|---|---|
| JP | 2000-338457 A | 12/2000 |
| JP | 2001-147420 A | 5/2001 |

OTHER PUBLICATIONS

Kader, Adem, et al., E72 Electronic Circuit Applications—Lab 3, Bipolar Transistors, Oct. 23, 2005.*

Kader, Adem, et al., E72 Electronic Circuit Applications—Lab 6 Switched Capacitor Circuits: Filters, Nov. 1, 2005.*

* cited by examiner

*Primary Examiner* — Alexander Eisen
*Assistant Examiner* — Nelson Lam
(74) *Attorney, Agent, or Firm* — Birch, Stewart, Kolasch & Birch, LLP

(57) ABSTRACT

An LCD device, which is cost effective, is discussed. According to one embodiment, the LCD device includes a timing controller to generate an initial POL signal; a signal stabilizer to receive the initial POL signal from the timing controller and a constant voltage from a source, and to generate a stabilized POL signal using the received constant voltage and the received initial POL signal; and a common voltage generator to generate a common voltage signal using the stabilized POL signal and to supply the generated common voltage signal to an LCD panel.

3 Claims, 4 Drawing Sheets

LIQUID CRYSTAL DISPLAY DEVICE

This application claims the benefit of the Korean Patent Application No. 10-2005-0057575 filed on Jun. 30, 2005 in Republic of Korea, which is hereby incorporated by reference as if fully set forth herein.

BACKGROUND OF THE INVENTION

1. Field of the Invention

The present invention relates to a liquid crystal display (LCD) device, and more particularly, to an LCD device in which a POL signal from a timing controller is stabilized without using a regulator.

2. Discussion of the Related Art

Demands for various display devices have increased with development of an information society. Accordingly, efforts have been made to research and develop various flat display devices such as liquid crystal display (LCD), plasma display panel (PDP), electroluminescent display (ELD), and vacuum fluorescent display (VFD). Some species of flat display devices have already been used as displays for different types of equipment.

Among the various flat display devices, liquid crystal display (LCD) devices have been widely used due to their advantageous characteristics of high picture quality, thin profile, lightness in weight, and low power consumption. As a result, the LCD devices are a substitute for Cathode Ray Tubes (CRTs). In addition to mobile type LCD devices such as a display for a notebook computer, LCD devices have been developed for computer monitors and televisions to receive and display broadcasting signals.

Despite various technical developments in the LCD technology having applications in different fields, research in enhancing the picture quality of the LCD device has been, in some respects, lacking as compared to other features and advantages of the LCD device.

In order to use LCD devices in various fields as a general display, one of the keys to developing such LCD devices depends on whether the LCD device can implement a high quality picture such as high resolution and high luminance with a large-sized screen while maintaining lightness in weight, thin profile, and low power consumption.

A general LCD device includes an LCD panel for displaying images, and a driver for applying a driving signal to the LCD panel. The LCD panel generally includes first and second substrates bonded to each other with a certain space therebetween, and a liquid crystal layer formed between the first and second substrates by injection.

The first substrate (TFT array substrate) according to a related art includes a plurality of gate lines arranged along a first direction at fixed intervals, a plurality of data lines arranged along a second direction perpendicular to the first direction at fixed intervals, a plurality of pixel electrodes formed in a matrix arrangement at pixel regions where the gate lines cross the data lines, and a plurality of thin film transistors (TFTs) switched by signals of the gate lines to transfer signals of the data lines to each pixel electrode.

The second substrate (color filter substrate) according to a related art includes a black matrix layer that shields light from certain portions except the pixel regions, R/G/B color filter layers for displaying various colors, and a common electrode for producing the image.

The common electrode is supplied with a common voltage signal generated from a common voltage generator. In case of a line inversion LCD device, the common voltage signal has an alternating current type inverted per horizontal period. At this time, the common voltage signal is generated by a POL signal from a timing controller. In more detail, a driver of a related art LCD device will be described below with reference to FIG. 1.

FIG. 1 illustrates a driver of a related art LCD device. Referring to FIG. 1, a direct current (DC)-to-DC converter 101 is supplied with an input voltage VCC from a system 100 and boosts or decompresses the input voltage VCC to output a reference voltage VDD, a high gate voltage VGH, and a low gate voltage VGL. The reference voltage VDD is supplied to a regulator 102. The regulator 102 stabilizes the reference voltage VDD and supplies the stabilized reference voltage VDD to a timing controller 103 as a power source. The timing controller 103 generates a POL signal using the stabilized reference voltage VDD and supplies the POL signal to a common voltage generator 104. The common voltage generator 104 inverts and amplifies the received POL signal.

The regulator 102 supplies the power source (stabilized reference voltage VDD) to the timing controller 103 to operate the timing controller 103. At this time, since the reference voltage output from the regulator 102 is a constant voltage, the POL signal is stably output from the timing controller 103. If the input voltage VCC from the system 100 is supplied to the timing controller 103 without the regulator 102, the POL signal output from the timing controller 103 is easily varied depending on the input voltage VCC from the system 100. If the POL signal is varied, a common voltage signal VCOM generated by the POL signal is also varied, which is a problem.

To prevent the common voltage signal VCOM from being varied, the LCD device is provided with the regulator 102. However, a problem arises in that the regulator 102 is expensive and increases the overall cost of the LCD device.

SUMMARY OF THE INVENTION

Accordingly, the present invention is directed to an LCD device that substantially obviates one or more problems due to limitations and disadvantages of the related art.

An object of the present invention is to provide an LCD device in which a constant voltage is supplied using a logic buffer or a transistor to stabilize a POL signal from a timing controller without using an expensive regulator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an LCD device according to an embodiment of the present invention includes a timing controller supplied with an input voltage from a system to output a POL signal, a signal stabilizer supplied with an external constant voltage and the POL signal from the timing controller to stabilize the external constant voltage and the POL signal, and a common voltage generator supplied with the POL signal stabilized by the stabilizer to output a common voltage signal, supplying the common voltage signal to an LCD panel.

According to one aspect of the present invention, there is provided an LCD device comprising a timing controller to generate an initial POL signal; a signal stabilizer to receive the initial POL signal from the timing controller and a constant voltage from a source, and to generate a stabilized POL signal using the received constant voltage and the received initial POL signal; and a common voltage generator to generate a common voltage signal using the stabilized POL signal and to supply the generated common voltage signal to an LCD panel.

According to another aspect of the present invention, there is provided an LCD device comprising: a timing controller to generate an initial POL signal; a signal stabilizer connected between the timing controller and a common voltage generator, and generating a stabilized POL signal using the initial POL signal; and the common voltage generator to generate a common voltage signal using the stabilized POL signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
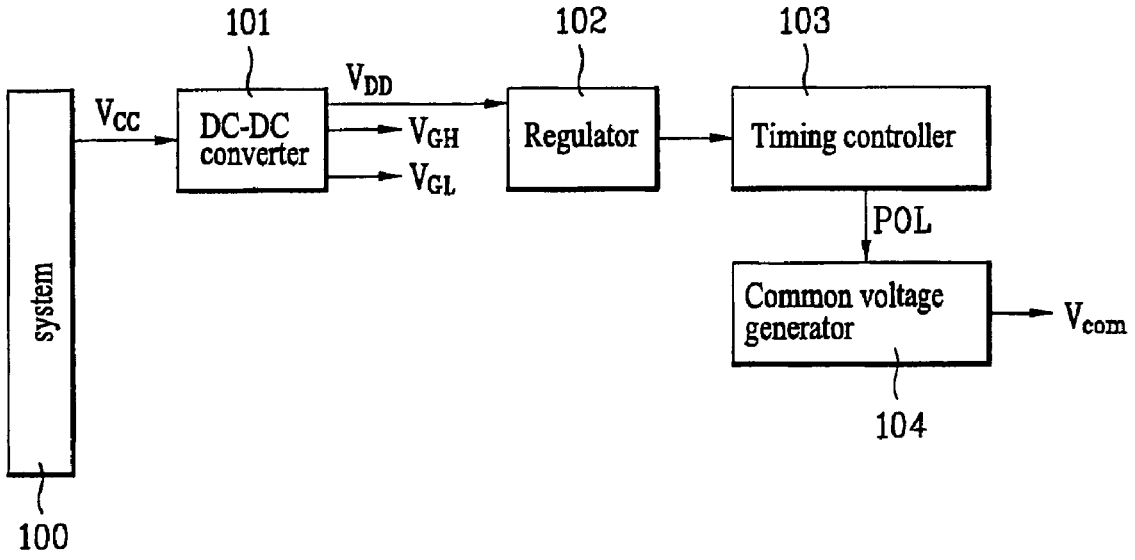
FIG. 1 Related Art
FIG. 1 illustrates a driver of a related art LCD device.
Figure 2:
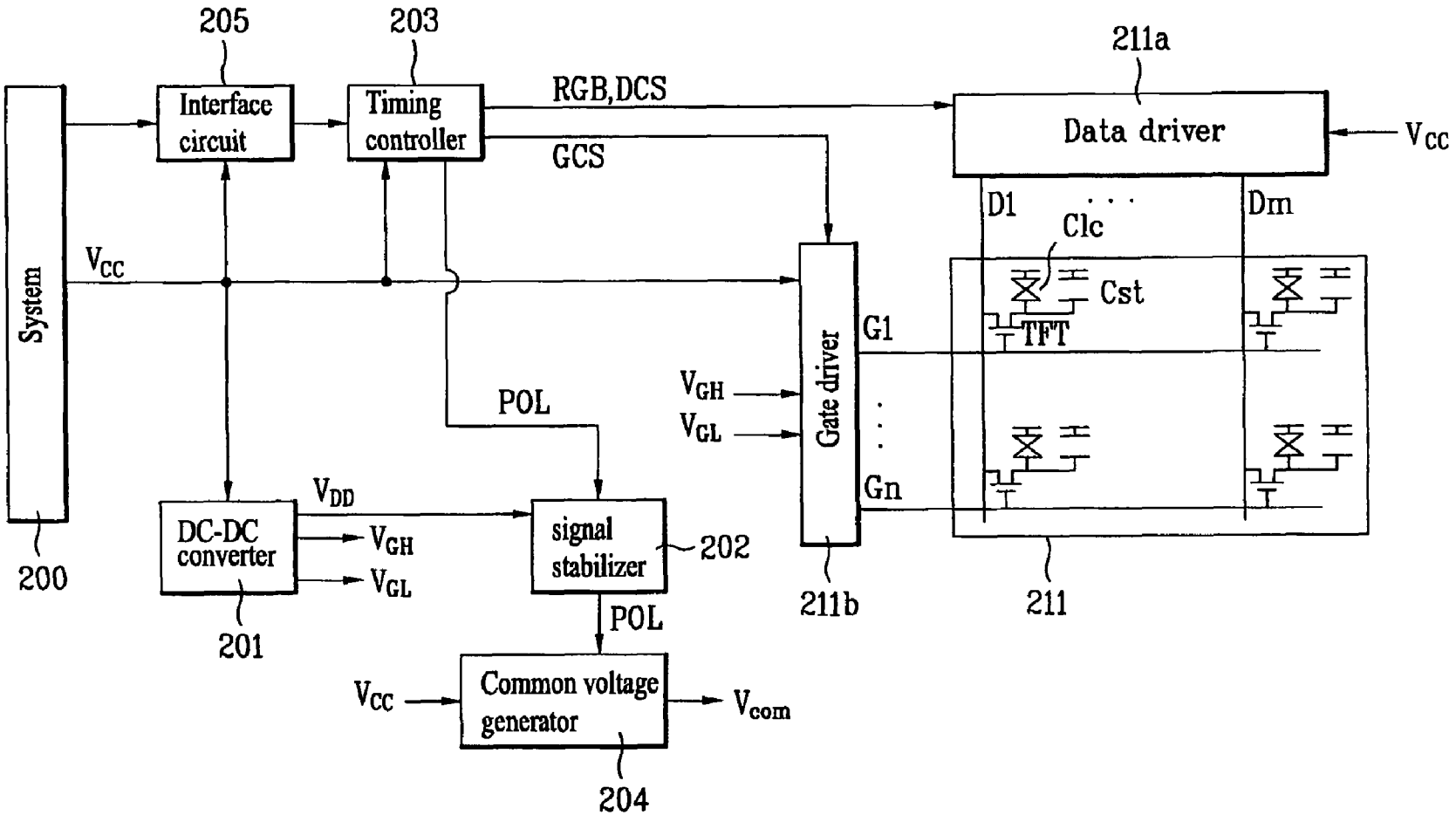
FIG. 2 illustrates an LCD device according to an embodiment of the present invention.

FIG. 2 illustrates an LCD device according to an embodiment of the present invention. All the components of the LCD device are operatively coupled.

As shown in FIG. 2, the LCD device according to one embodiment of the present invention includes an LCD panel 211, a data driver 211*a*, a gate driver 211*b*, a timing controller 203, a DC-to-DC converter 201, a signal stabilizer 202, and a common voltage generator 204. The display panel 211 is provided with m×n pixels arranged in a matrix arrangement, m data lines (D1 to Dm) vertically crossing n gate lines (G1 to Gn), and thin film transistors (TFTs) formed at regions where the data lines cross the gate lines.

The data driver 211*a* supplies data to the data lines D1 to Dm of the LCD panel 211. The gate driver 211*b* supplies scan signals to the gate lines G1 to Gn. The timing controller 203 outputs respectively gate control signals GCS and data control signals DCS to control the gate driver 211*b* and the data driver 211*a* using synchronizing signals from an interface circuit 205, and outputs to the signal stabilizer 202 a POL signal required to generate a common voltage signal VCOM. The DC-to-DC converter 201 generates voltages supplied to the LCD panel 211. The signal stabilizer 202 stabilizes the POL signal received from the timing controller 203 as a constant voltage, and outputs the stabilized POL signal to the common voltage generator 204. The common voltage generator 204 receives the stabilized POL signal output from the signal stabilizer 202 and generates the common voltage signal VCOM using the stabilized POL signal to supply it to the LCD panel 211.

A system 200 supplies appropriate signals such as vertical/horizontal synchronizing signals, clock signals and data (RGB) to the interface circuit 205 through a low voltage differential signaling transmitter of a graphic controller and supplies an input voltage VCC generated from its power source to the respective digital circuit devices 203, 211*a*, 211*b* and 205, the common voltage generator 204 and the DC-to-DC converter 201.

Meanwhile, in the LCD panel 211, a liquid crystal is injected or otherwise provided between two glass substrates. Various structures of these two glass substrates are known and can be present in the LCD panel 211. In this embodiment, the data lines D1 to Dm and the gate lines G1 to Gn formed on the lower glass substrate of the LCD panel 211 vertically cross each other. The TFTs formed at crossing points between the data lines D1 to Dm and the gate lines G1 to Gn supply data on the data lines D1 to Dn to liquid crystal cells C1*c* in response to the scan signals from the gate lines G1 to Gn. To this end, a gate electrode of each TFT is connected to a corresponding gate line and its source electrode is connected to a corresponding data line. A drain electrode of each TFT is connected to a pixel electrode of a corresponding liquid crystal cell C1*c*.

In one embodiment, a black matrix layer and color filter layers and a common electrode are formed on the upper glass substrate of the LCD panel 211. Polarizing plates whose polarizing axes vertically cross each other are attached onto the upper and lower glass substrates of the LCD panel 211. An alignment film is formed on an inner side adjoining the liquid crystal to set a pre-tilt angle of the liquid crystal. A storage capacitor Cst is formed in each liquid crystal cell C1*c* of the LCD panel 211. The storage capacitor Cst is formed between the pixel electrode of the liquid crystal cell C1*c* and a previous gate line or between the pixel electrode of the liquid crystal cell C1*c* and a common electrode line to uniformly maintain a voltage of the liquid crystal cell C1*c*.

The data driver 211*a* converts digital video data (RGB) to analog gamma voltages corresponding to a gray level in response to the data control signals DCS output from the timing controller 203 and supplies the analog gamma voltages to the data lines D1 to Dm. The input voltage VCC from the power source of the system 200 is supplied to a data drive integrated circuit in which the data driver 211*a* is integrated.

On the other hand, the gate driver 211*b* sequentially supplies the scan pulses to the gate lines G1 to Gn in response to the gate control signals GCS output from the timing controller 203 and selects a horizontal line of the LCD panel 211 supplied with the data. The input voltage VCC from the power source of the system 200 is supplied to a gate drive integrated circuit in which the gate driver 211*b* is integrated.

The timing controller 203 generates the gate control signals GCS for controlling the gate driver 211*b*, the data control signals DCS for controlling the data driver 211*a*, and the POL signal required to generate the common voltage from the common voltage generator 204 using the vertical/horizontal synchronizing signals input from the graphic controller of the system 200 through the interface circuit 205.

The timing controller 203 realigns the digital video data (RGB) input from the graphic controller of the system 200 through the interface circuit 205 and supplies the realigned digital video data to the data driver 211*a*. The input voltage VCC from the power source of the system 200 is supplied to the timing controller 203.

The interface circuit 205 lowers voltage levels of the signals input from the graphic controller of the system 200 and a low voltage differential signaling receiver and enhances frequencies of the signals, so as to reduce the number of signal lines required between the system 200 and the timing controller 203. The input voltage VCC from the power source of the system 200 is supplied to the interface circuit 205.

An electromagnetic interference (EMI) filter is provided between the interface circuit 205 and the timing controller 203 to reduce EMI generated due to high voltage and high frequency components of the signals supplied from the interface circuit 205 to the timing controller 203.

Meanwhile, the DC-to-DC converter 201 boosts or decompresses the input voltage VCC from the power source of the system 200 through a connector to generate a voltage to be supplied to the LCD panel 211. To this end, the DC-to-DC converter 201 includes an output switching device for switching output voltages at an output terminal, and a pulse width modulator (PWM) or a pulse frequency modulator (PFM) for boosting or decompressing the output voltages by controlling a duty ratio or frequency of a control signal of the output switching device. The pulse width modulator enhances the output voltages of the DC-to-DC converter 201 by enhancing the duty ratio of the control signal of the output switching device or lowers the output voltages of the DC-to-DC converter 201 by lowering the duty ratio of the control signal of the output switching device.

The pulse frequency demodulator enhances the output voltages of the DC-to-DC converter 201 by enhancing the frequency of the control signal of the output switching device or lowers the output voltages of the DC-to-DC converter 201 by lowering the frequency of the control signal of the output switching device. The output voltages of the DC-to-DC converter 201 are voltages/signals output from the DC-to-DC converter 201.

The output voltages of the DC-to-DC converter 201 include a reference voltage VDD of, e.g., 5V or greater, gamma reference voltages GMA1~GMA10 less than ten stages, a high gate voltage VGH of, e.g., 15V or greater, and a low gate voltage VGL of, e.g., −4V or less. The gamma reference voltages GMA1~GMA10 are generated by partial pressure of the reference voltage VDD. The reference voltage VDD and the gamma reference voltages GMA1~GMA10 are supplied to the data driver 211*a* as analog gamma voltages. The high gate voltage VGH is a high logic voltage of the scan pulses set at a threshold voltage of the TFT or greater and is supplied to the gate driver 211*b*. The low gate voltage VGL is a low logic voltage of the scan pulses set at an off voltage of the TFT and is supplied to the gate driver 211*b*.

The signal stabilizer 202 is supplied with the POL signal output from the timing controller 203 and with the reference voltage VDD output from the DC-to-CD converter 201. In the LCD device according to the present invention, since the timing controller 203 is supplied with the input voltage VCC from the system 200, which is not a constant voltage, the POL signal output from the timing controller 203 is not constant and varies depending on the input voltage VCC.

To prevent the POL signal from being varied, the signal stabilizer 202 is provided in the present invention. The signal stabilizer 202 processes the POL signal output from the timing controller 203 and generates a stabilized POL signal (a constant high/low voltage) using the reference voltage VDD. The signal stabilizer 202 thus supplies the POL signal having the constant high voltage to the common voltage generator 204. A logic buffer, a plurality of transistors, or other similar elements may be used as the signal stabilizer 20. However, a more detailed operation of the signal stabilizer 202 will be discussed later referring to FIG. 4.

The common voltage generator 204 generates the common voltage signal VCOM using the POL signal output from the signal stabilizer 202. At this time, since the POL signal input to the common voltage generator 204 is a constant voltage, the common voltage signal VCOM is stably output from the common voltage generator 204.

The common voltage generator 204 will now be described in more detail.

Figure 3:
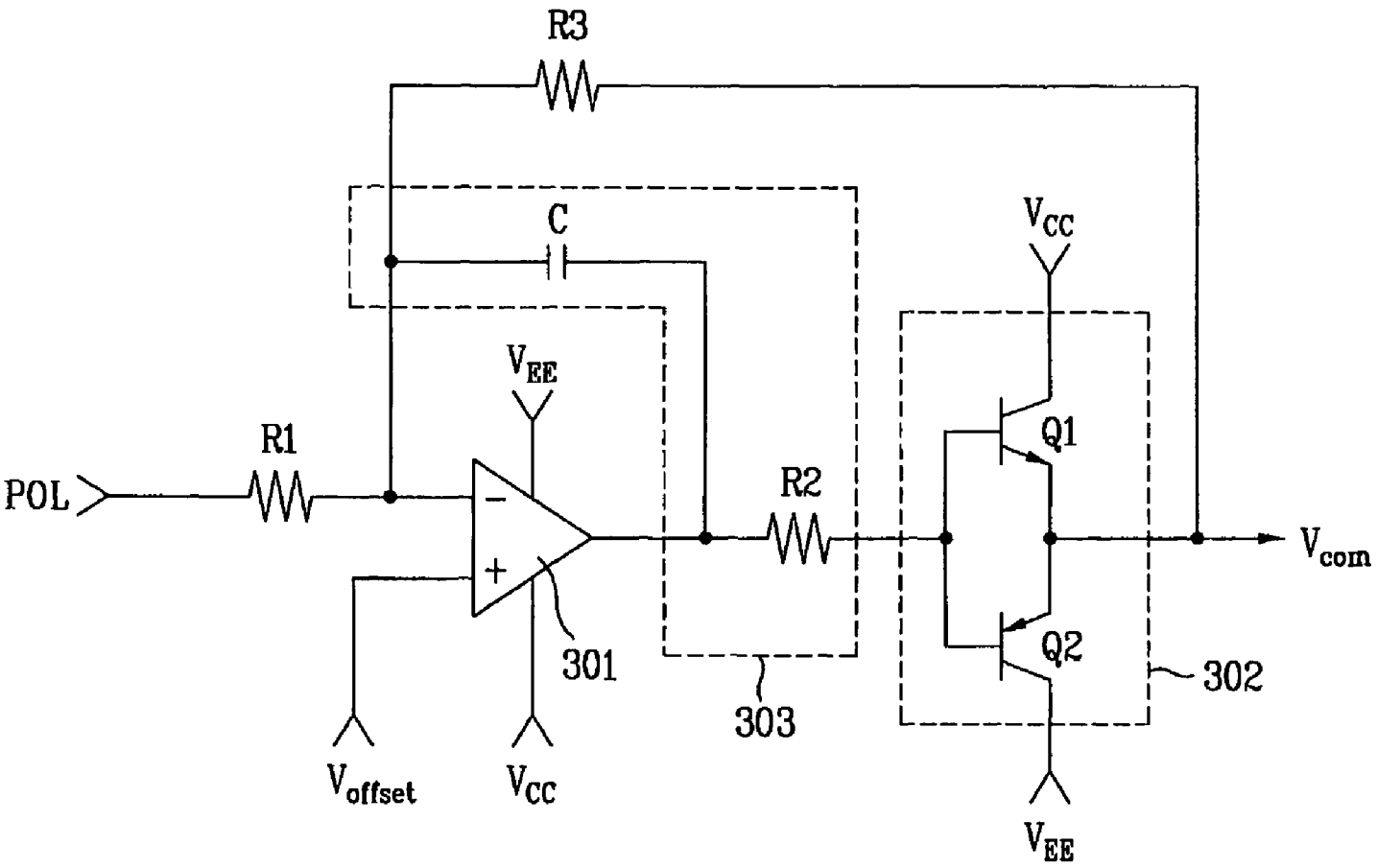
FIG. 3 is a circuit diagram illustrating a common voltage generator of FIG. 2 according to an embodiment of the present invention.

FIG. 3 is a circuit diagram illustrating the common voltage generator 204 of FIG. 2 according to an embodiment of the present invention.

As shown in FIG. 3, the common voltage generator 204 includes an inversion amplifier 301 for inverting and amplifying a differential voltage between the POL signal input through an inversion terminal of the inversion amplifier 301 and an offset voltage (Voffset) input through a non-inversion terminal of the inversion amplifier 301, and a buffer 302 for alternately switching and buffering first and second transistors Q1 and Q2 depending on a level of the voltage obtained from the inversion amplifier 301, feeding the output values back to the inversion amplifier 301 through a resistor R3, and amplifying the feedback signals.

The voltage output from the buffer 302 is the common voltage VCOM.

The aforementioned common voltage generator 204 outputs inverted and amplified signals depending on a set gain, i.e., a resistance ratio (R1/R2), if the POL signal is input to the inversion amplifier 301 per one horizontal synchronization (1 Hsync).

The signals output from the inversion amplifier 301 are input to respective base terminals of the first and second transistors Q1 and Q2. Thus, the first and second transistors Q1 and Q2 alternately switch the supplied power source to generate the common voltage signal VCOM of a constant globular wave. In other words, if the signals output from the inversion amplifier 301 are at high level, the first transistor Q1 corresponding to an NPN transistor applied with the high potential voltage is turned on while the second transistor Q2 corresponding to a PNP transistor is turned off, so that the common voltage signal VCOM of high level is output. If the signals output from the inversion amplifier 301 are at low level, the second transistor Q2 corresponding to the PNP transistor applied with the low potential voltage is turned on while the first transistor Q1 corresponding to the NPN transistor is turned off, so that the common voltage signal VCOM of low level is output.

The common voltage generator 204 further includes a noise attenuator 303 that attenuates the signal output from the inversion amplifier 301. The noise attenuator 303 includes a capacitor C connected between an output terminal of the inversion amplifier 301 and the inversion terminal of the inversion amplifier 301, and a resistor R2 connected between the output terminal of the inversion amplifier 301 and an input terminal of the buffer 302.

Figure 4:
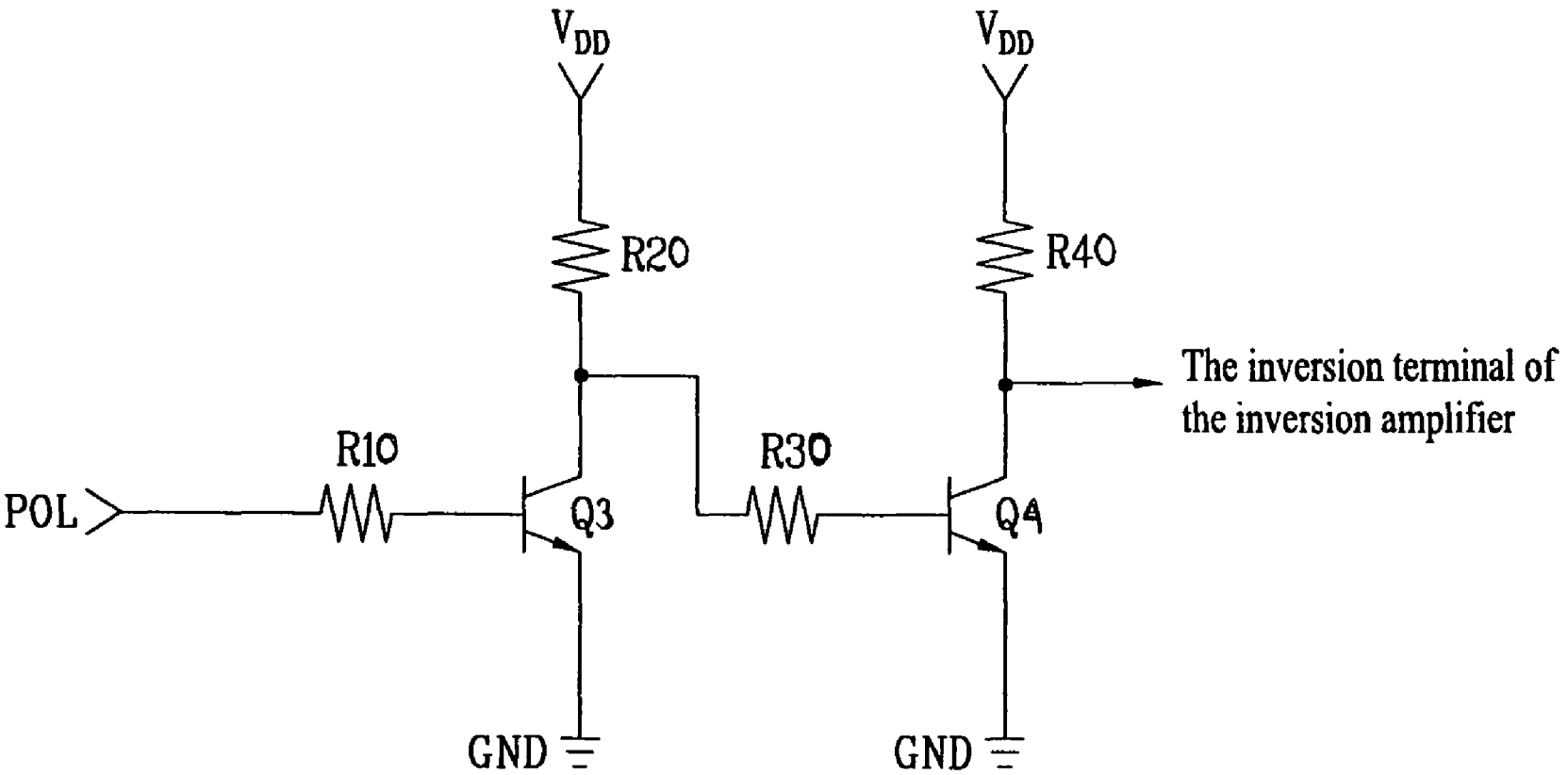
FIG. 4 is a circuit diagram illustrating a signal stabilizer of FIG. 2 according to an embodiment of the present invention.

FIG. 4 is a circuit diagram illustrating the signal stabilizer 202 of FIG. 2 according to an embodiment of the present invention.

As shown in FIG. 4, the signal stabilizer 202 includes first and second transistors Q3 and Q4. The first transistor Q3 includes a base terminal to which the POL signal from the timing controller 203 is input, a collector terminal to which the reference voltage VDD from the DC-to-DC converter 201 is input, and an emitter terminal connected to a ground terminal. The second transistor Q4 includes a base terminal connected to the collector terminal of the first transistor Q3, a collector terminal to which the reference voltage VDD is input, and an emitter terminal connected to the ground terminal. The collector terminal of the second transistor Q2 is connected to the inversion terminal of the inversion amplifier 301 provided in the common voltage generator 204, through a resistor R1 (FIG. 3), so as to supply the stabilized POL signal to the common voltage generator 204. Resistors such as R10, R20, R30, R40, etc. are included in the signal stabilizer 202.

The operation of the aforementioned signal stabilizer 202 will be now described in detail.

If the POL signal input to the signal stabilizer 202 is at high level, the first transistor Q3 is turned on so that a ground voltage GND is supplied to the collector terminal of the first transistor Q3. As a result, the second transistor Q4 whose base terminal is connected to the collector terminal of the first transistor Q3 is turned off. Therefore, the reference voltage VDD is supplied to the collector terminal of the second transistor Q2. The reference voltage VDD supplied to the collector terminal of the second transistor Q2 is then supplied to the inversion terminal of the inversion amplifier 301 (FIG. 3) provided in the common voltage generator 204, as a stabilized POL signal.

On the other hand, if the POL signal input to the signal stabilizer 202 is at low level, the first transistor Q3 is turned off so that the reference voltage VDD is supplied to the collector terminal of the first transistor Q3. As a result, the second transistor Q4 whose base terminal is connected to the collector terminal of the first transistor Q3 is turned on. Therefore, the ground voltage GND is supplied to the collector terminal of the second transistor Q2 and to the inversion terminal of the inversion amplifier 204.

As described above, the signal stabilizer 202 supplies the reference voltage VDD or the ground voltage GND to the inversion terminal of the inversion amplifier 301 through the first and second transistors Q3 and Q4, so that the common voltage generator 204 generates the common voltage signal VCOM. At this time, since the reference voltage VDD output to the common voltage generator 204 by the signal stabilizer 202 is a constant voltage, the common voltage signal VCOM is stably generated and output from the common voltage generator 204.

In the related art LCD device, to stably output a POL signal from a timing controller, a constant voltage is directly supplied to the timing controller using a regulator which has a high cost. However, in the LCD device according to the present invention, the input voltage VCC is supplied to a timing controller, and only the POL signal output from the timing controller is stabilized through a logic buffer or transistor(s). Therefore, in the present invention, the regulator for supplying the constant voltage to the timing controller is not required and eliminated.

Accordingly, the LCD device according to the present invention has advantages including, but not limited to, the following.

Since the constant voltage is supplied using the logic buffer or the transistor(s), it is possible to stabilize a POL signal output from the timing controller without using a regulator, which is expensive. As a result, a cost-effective driver for a display device can be provided in an effective manner.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device comprising:

a system supplying a vertical synchronizing signal, a horizontal synchronizing signal and clock signals to a interface circuit, and generating an input voltage from its power source, wherein the input voltage is a source signal of a reference voltage, a high gate voltage and a low gate voltage;

a timing controller to generate an initial POL signal, wherein the timing controller generates the initial POL signal using the input voltage from the system, wherein the input voltage from the system is supplied directly to the timing controller, wherein the timing controller realigns digital video data input from the system through the interface circuit;

a signal stabilizer to receive the initial POL signal from the timing controller and a constant voltage from a source, and to generate a stabilized POL signal using the received constant voltage and the received initial POL signal, wherein the source that supplies the constant voltage is a DC-to-DC converter;

a common voltage generator to generate a common voltage signal using the stabilized POL signal and to supply the generated common voltage signal to an LCD panel;

a gate driver to generate scan pulses using the high gate voltage and the low gate voltage, and to supply the scan pulses to gate lines of the LCD panel; and a data driver to convert the digital video data input from the timing controller to analog gamma voltages corresponding to a gray level;

wherein the interface circuit, the timing controller, the signal stabilizer, the source, the common voltage generator, the gate driver and the data driver are provided with the input voltage from the power source of the system;

wherein the DC-to-DC converter boosts or decompresses the input voltage from the power source of the system to generate the reference voltage, the high gate voltage and the low gate voltage;

wherein the signal stabilizer includes:

a first switching device having a base terminal to which the initial POL signal input, a collector terminal to which the constant voltage is input, and an emitter terminal connected to a ground terminal;

a second switching device having a base terminal connected to the collector terminal of the first switching device, a collector terminal to which the constant voltage is input, and an emitter terminal connected to the ground terminal;

wherein the collector terminal of the second switching device is connected to the common voltage generator so as to provide the stabilized POL signal to the common voltage generator;

wherein the common voltage generator includes:

an inversion amplifier to invert and amplify a differential voltage between the stabilized POL signal input to its inversion terminal and an offset voltage input to its non-inversion terminal;

a buffer to buffer a voltage output from the inversion amplifier depending on a level of the voltage output from the inversion amplifier and feeding an output voltage of the buffer back to the inversion amplifier to amplify the output voltage of the buffer;

a noise attenuator having a capacitor connected between an output terminal of the inversion amplifier and the inversion terminal, and a resistor connected between the output terminal of the inversion amplifier and an input terminal of the buffer; and wherein the initial POL signal output from the timing controller is not constant and varies depending on the input voltage.

2. A liquid crystal display (LCD) device comprising:

a system supplying a vertical synchronizing signal, a horizontal synchronizing signal and clock signals to a interface circuit, and generating an input voltage from its power source, wherein the input voltage is a source signal of a reference voltage, a high gate voltage and a low gate voltage;

a timing controller to generate an initial POL signal, wherein the timing controller generates the initial POL signal using the input voltage from the system, wherein the input voltage from the system is supplied directly to the timing controller, wherein the timing controller realigns digital video data input from the system through the interface circuit;

a signal stabilizer connected between the timing controller and a common voltage generator, and generating a stabilized POL signal using the initial POL signal;

a DC-to-DC converter to supply a constant voltage directly to the signal stabilizer, so that the signal stabilizer can use the constant voltage in generating the stabilized POL signal;

the common voltage generator to generate a common voltage signal using the stabilized POL signal;

a gate driver to generate scan pulses using the high gate voltage and the low gate voltage, and to supply the scan pulses to gate lines of an LCD panel; and a data driver to convert the digital video data input from the timing controller to analog gamma voltages corresponding to a gray level;

an LCD panel to display images using the common voltage signal;

wherein the interface circuit, the timing controller, the signal stabilizer, the DC-to-DC converter, the common voltage generator, the gate driver and the data driver are provided with the input voltage from the power source of the system;

wherein the DC-to-DC converter boosts or decompresses the input voltage from the power source of the system to generate the reference voltage, the high gate voltage and the low gate voltage;

wherein the signal stabilizer includes a logic buffer;

wherein the common voltage generator includes:

an inversion amplifier to invert and amplify a differential voltage between the stabilized POL signal input to its inversion terminal and an offset voltage input to its non-inversion terminal;

a buffer to buffer a voltage output from the inversion amplifier depending on a level of the voltage output from the inversion amplifier and feeding an output voltage of the buffer back to the inversion amplifier to amplify the output voltage of the buffer;

a noise attenuator having a capacitor connected between an output terminal of the inversion amplifier and the inversion terminal, and a resistor connected between the output terminal of the inversion amplifier and an input terminal of the buffer; and wherein the initial POL signal output from the timing controller is not constant and varies depending on the input voltage.

3. A liquid crystal display (LCD) device comprising:

a system supplying a vertical synchronizing signal, a horizontal synchronizing signal and clock signals to a interface circuit, and generating an input voltage from its power source, wherein the input voltage is a source signal of a reference voltage, a high gate voltage and a low gate voltage;

a timing controller to generate an initial POL signal, wherein the timing controller generates the initial POL signal using the input voltage from the system, wherein the input voltage from the system is supplied directly to the timing controller, wherein the timing controller realigns digital video data input from the system through the interface circuit;

a signal stabilizer connected between the timing controller and a common voltage generator, and generating a stabilized POL signal using the initial POL signal;

a DC-to-DC converter to supply a constant voltage directly to the signal stabilizer, so that the signal stabilizer can use the constant voltage in generating the stabilized POL signal;

the common voltage generator to generate a common voltage signal using the stabilized POL signal;

a gate driver to generate scan pulses using the high gate voltage and the low gate voltage, and to supply the scan pulses to gate lines of an LCD panel; and a data driver to convert the digital video data input from the timing controller to analog gamma voltages corresponding to a gray level;

an LCD panel to display images using the common voltage signal;

wherein the interface circuit, the timing controller, the signal stabilizer, the DC-to-DC converter, the common voltage generator, the gate driver and the data driver are provided with the input voltage from the power source of the system;

wherein the DC-to-DC converter boosts or decompresses the input voltage from the power source of the system to generate the reference voltage, the high gate voltage and the low gate voltage;

wherein the common voltage generator includes:

an inversion amplifier to invert and amplify a differential voltage between the stabilized POL signal input to its inversion terminal and an offset voltage input to its non-inversion terminal;

a buffer to buffer a voltage output from the inversion amplifier depending on a level of the voltage output from the inversion amplifier and feeding an output voltage of the buffer back to the inversion amplifier to amplify the output voltage of the buffer;

a noise attenuator having a capacitor connected between an output terminal of the inversion amplifier and the inversion terminal, and a resistor connected between the output terminal of the inversion amplifier and an input terminal of the buffer;

wherein the initial POL signal output from the timing controller is not constant and varies depending on the input voltage;

wherein the stabilizer includes:

a first switching device to receive the initial POL signal; and a second switching device connected to the common voltage generator, wherein the first and second switching devices are connected to each other and each receives the constant voltage from the DC-to-DC converter.

* * * * *